US006644374B2

(12) United States Patent
Nien

(10) Patent No.: US 6,644,374 B2
(45) Date of Patent: Nov. 11, 2003

(54) VENETIAN BLIND THAT KEEPS LIFT CORDS CONCEALED

(75) Inventor: Ming Nien, Changhua Hsien (TW)

(73) Assignee: Nien Made Enterprise Co., Ltd., Changhua Hsien (TW)

( * ) Notice: Subject to any disclaimer, the term of this patent is extended or adjusted under 35 U.S.C. 154(b) by 0 days.

(21) Appl. No.: 10/170,586

(22) Filed: Jun. 14, 2002

(65) Prior Publication Data

US 2003/0192655 A1 Oct. 16, 2003

(30) Foreign Application Priority Data

Apr. 11, 2002 (TW) ..... 91204731 U

(51) Int. Cl.[7] ..... E06B 9/30
(52) U.S. Cl. ..... 160/168.1 R; 160/170 R
(58) Field of Search ..... 160/168.1 R, 173 R, 160/170 R, 172 R, 107, 178.1 R, 171 R

(56) References Cited

U.S. PATENT DOCUMENTS 2,059,134 A * 10/1936 Metcalf ..... 160/168.1 R
2,328,305 A * 8/1943 Stefano ..... 160/172 R
2,389,956 A * 11/1945 Castilonia ..... 160/172 R
3,123,130 A * 3/1964 Fridlund ..... 160/168.1 R
3,633,646 A * 1/1972 Zilver ..... 160/172 R
3,795,267 A * 3/1974 Debs ..... 160/168.1 R
5,645,685 A * 7/1997 Furhman ..... 160/168.1 R
5,671,793 A * 9/1997 Lee ..... 160/168.1 R
5,709,258 A * 1/1998 Coccoluto ..... 160/168.1 R
5,850,863 A * 12/1998 Huang ..... 160/168.1 R
5,904,198 A * 5/1999 Huang ..... 160/168.1 R
5,996,668 A * 12/1999 DeBlock et al. ..... 160/107
6,516,860 B1 * 2/2003 Weaver et al. ..... 160/168.1 R

* cited by examiner

*Primary Examiner*—David Purol
(74) *Attorney, Agent, or Firm*—Bacon & Thomas, PLLC

(57) ABSTRACT

A Venetian blind is constructed to include a headrail, a bottom rail, a set of slats, at least one lift cord, each lift cord having a first end fixedly fastened to the bottom rail and a second end upwardly inserted through the slats into the inside of the headrail and extended transversely to one end of the headrail and then turned downwards to the outside of the headrail, and a sleeve suspended from the headrail and adapted for receiving the second end of each lift cord for enabling the second end of each lift cord to be selectively positioned in one of a series of vertical positions in the sleeve.

4 Claims, 7 Drawing Sheets

VENETIAN BLIND THAT KEEPS LIFT CORDS CONCEALED

BACKGROUND OF THE INVENTION

1. Field of the Invention

The present invention relates to Venetian blinds and, more specifically, to such a Venetian blind that keeps the lift cords concealed.

2. Description of the Related Art

A regular Venetian blind is generally comprised of a top rail, a bottom rail, a plurality of slats arranged in parallel between the top rail and the bottom rail, a lift control mechanism for controlling lifting and positioning of the bottom rail to adjust the extending area of the Venetian blind, and a tilting control mechanism for controlling the tilting angle of the slats to regulate the light. The lift control mechanism comprises a lift cord suspended from the top rail at one side for operation by hand to control the elevation of the bottom rail. Because the lift cord is exposed to the outside, it destroys the sense of beauty of the Venetian blind. Further, because a child can easily reach the exposed lift cord, an accident may occur when the child pulls on the lift cord for fun. In order to eliminate this problem, Venetian blinds with receivable lift cord(s) are developed. Exemplars of these Venetian blinds are seen in U.S. Pat. Nos. 2,382,100; 5,531,257; and 3,014,124. However, these Venetian blinds commonly have a complicated structure and high manufacturing cost.

SUMMARY OF THE INVENTION

It is the main object of the present invention to provide a Venetian blind, which keeps the lift cords concealed and out of reach of children.

It is another object of the present invention to provide a Venetian blind, which enables the user to control the lifting and positioning of the slats easily.

It is still another object of the present invention to provide a lift cord concealable Venetian blind, which has a simple structure and, is inexpensive to manufacture.

To achieve these objects of the present invention, the Venetian blind comprises a headrail, a bottom rail, a set of slats, at least one lift cord, each lift cord having a first end fixedly fastened to the bottom rail and a second end upwardly inserted through the slats into the inside of the headrail and extended transversely to one end of the headrail and then turned downwards to the outside of the headrail, and a sleeve suspended from the headrail and adapted for receiving the second end of each lift cord for enabling the second end of each lift cord to be selectively positioned in one of a series of vertical positions in the sleeve.

DETAILED DESCRIPTION OF THE PREFERRED EMBODIMENT

Figure 1:
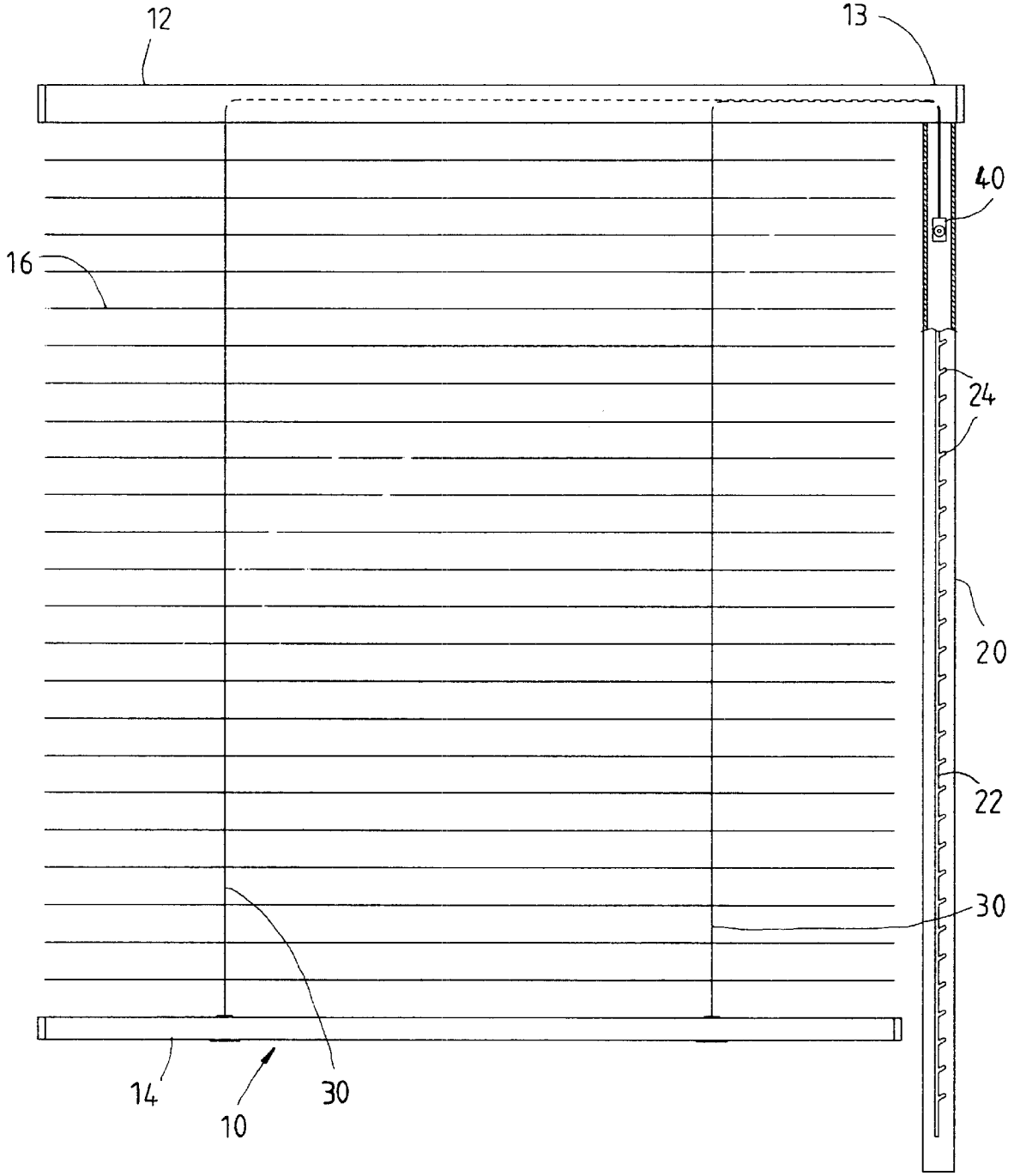
FIG. 1 is a schematic drawing of a first embodiment of the present invention, showing the Venetian blind extended out.
Figure 2:
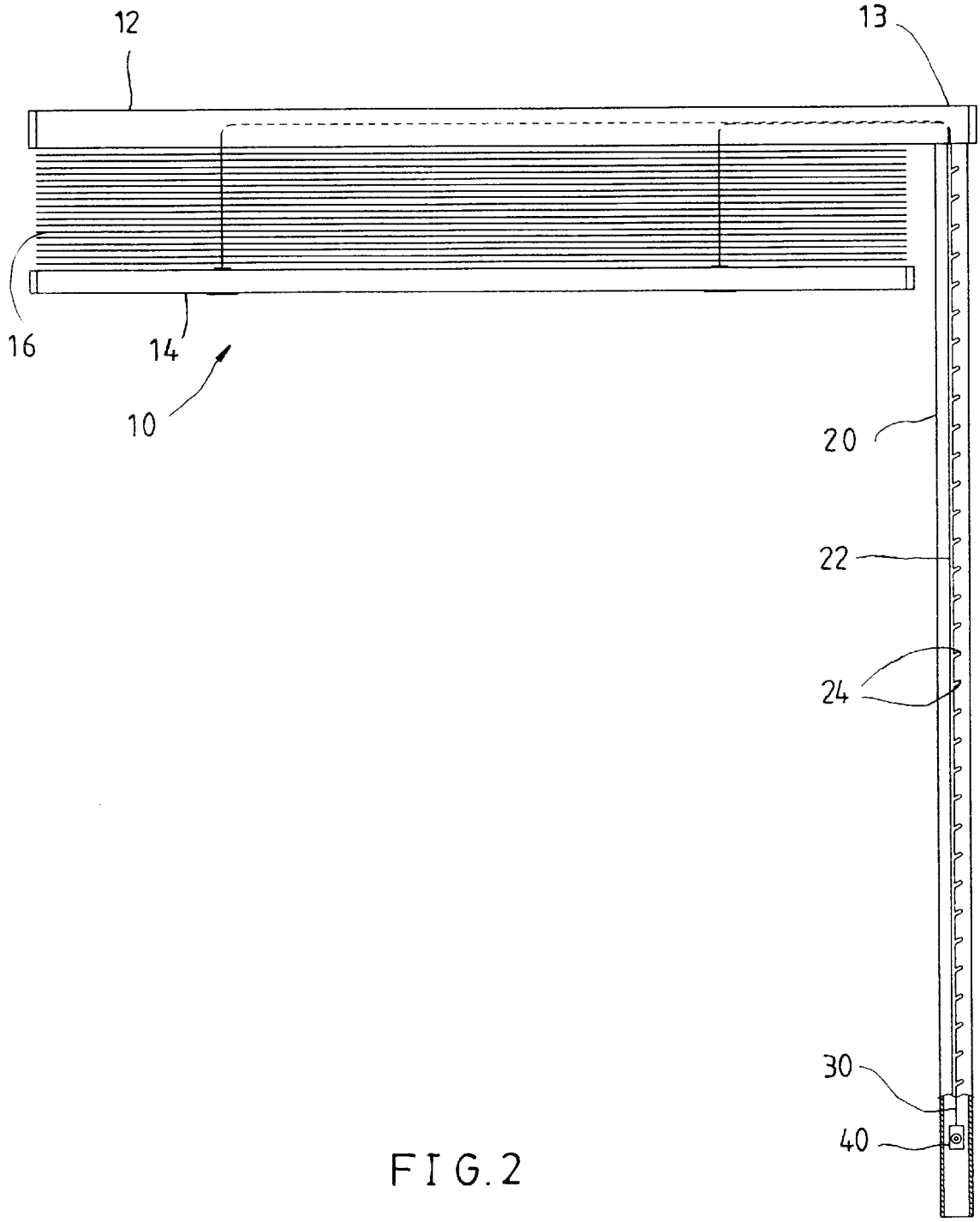
FIG. 2 is a schematic drawing corresponding to FIG. 1, showing a received status of the Venetian blind.

Referring to FIGS. from 1 through 7, a Venetian blind 10 is shown comprising a headrail 12 fixedly transversely fastened to the top side of the window, the headrail 12 having a first end 13 (the right end), a bottom rail 14 extended in transverse direction and spaced below the headrail 12, a number of slats 16 arranged in parallel between the headrail 12 and the bottom rail 14, a sleeve 20, two lift cords 30, and a lift cord endpiece 40.

The sleeve 20 is a straight tube vertically suspended from the first end 13 of the headrail 12 (alternatively, the sleeve can be fixedly fastened to one lateral side of the window), keeping the inside space in communication with the inside space of the headrail 12. The sleeve 20 has a longitudinal slot 22 longitudinally extended between the top and bottom ends, and a plurality of elongated retaining notches 24 obliquely upwardly extended from the longitudinal slot 22 at different elevations at an equal pitch. According to this embodiment, the elongated retaining notches 24 are respectively extended from the longitudinal slot 22 at the same time. Alternatively, the elongated retaining notches 24 can be alternatively extended from the longitudinal slot 22 at two sides at different elevations.

The lift cords 30 have a respective first end symmetrically fixedly fastened to the bottom rail 14, and a respective top end upwardly inserted through a respective through hole (not shown) in each slat 16 and then inserted into the inside of the headrail 12 and then extended in the same direction toward the first end 13 of the headrail 12 and then extended downwards to the inside of the sleeve 20 (alternatively, one single lift cord may be used and inserted through a first through hole in each slat 16 and the bottom rail 14 and then inserted through a second through hole in the bottom rail 14 and each slat 16 and then extended through the headrail out of the first end 13 of the headrail 12 to the inside of the sleeve 20; subject to the size of the Venetian blind, three lift cords may be used).

The lift cord endpiece 40 comprises a barrel-like body 41 received in the sleeve 20, the body 41 having a bottom chamber 42 and a center through hole 43 axially disposed in communication with the bottom chamber 42, a rod 44 perpendicularly extended from the periphery of the body 41 and extended through the longitudinal slot 22 of the sleeve 20, and a spherical knob 45 fixedly fastened to the end of the rod 44 and disposed outside the sleeve 20. The diameter of the rod 44 is smaller than the width of the longitudinal slot 22 and the elongated retaining notches 24. The diameter of the spherical knob 45 is greater than the width of the longitudinal slot 22 and the elongated retaining notches 24.

Figure 7:
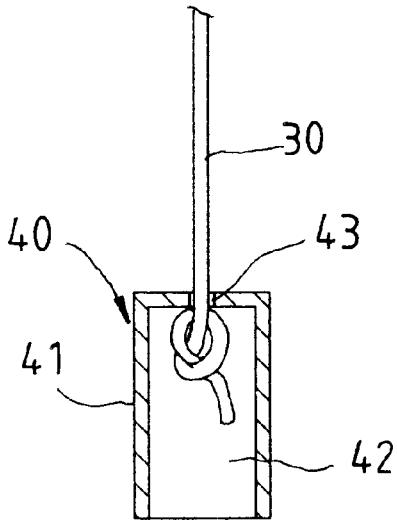
FIG. 7 is a schematic structural view showing the connection between the lift cords and the lift cord endpiece according to the first embodiment of the present invention.
Figure 8:
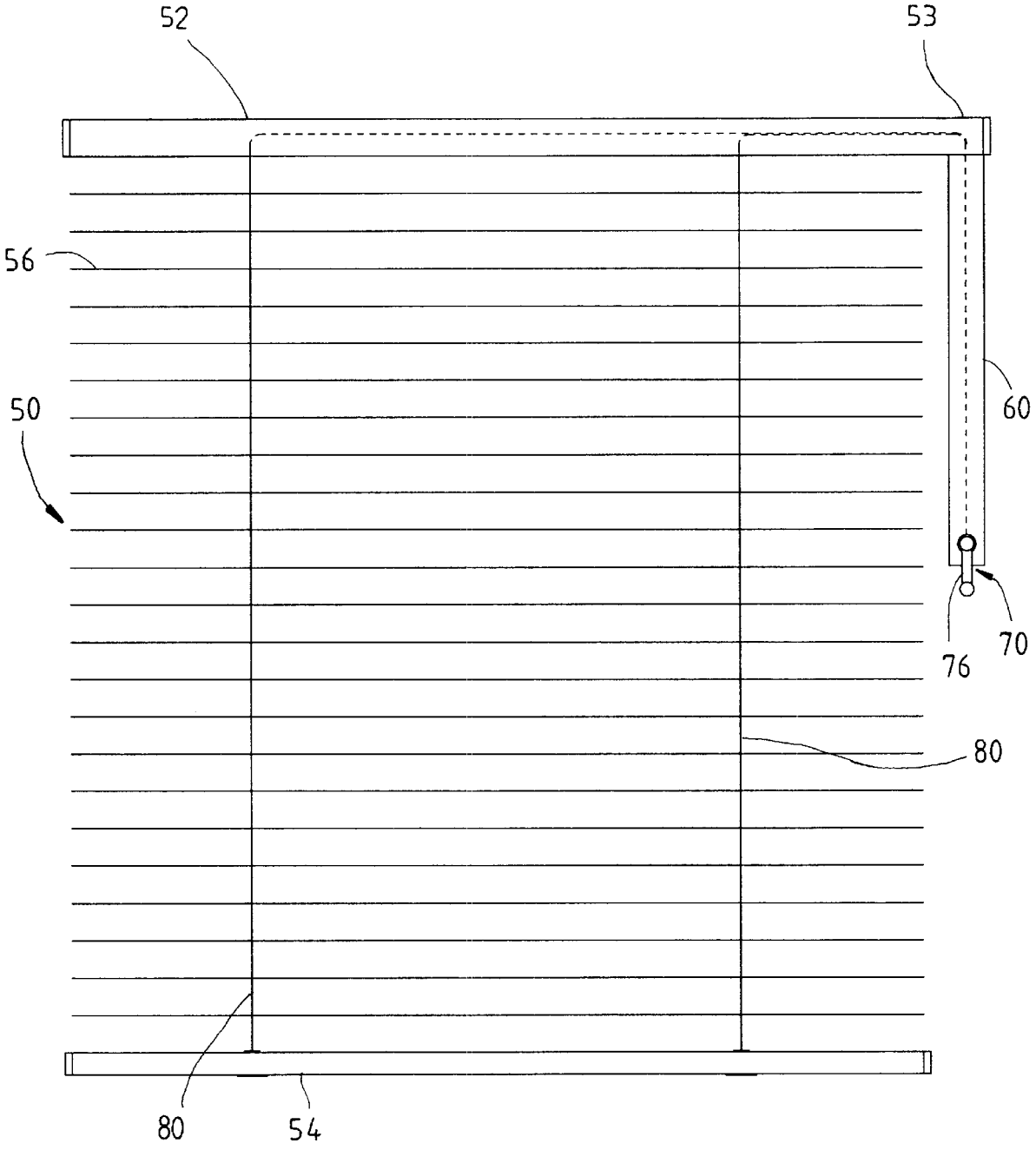
FIG. 8 is a schematic structural view of a Venetian blind according to a second embodiment of the present invention.
Figure 9:
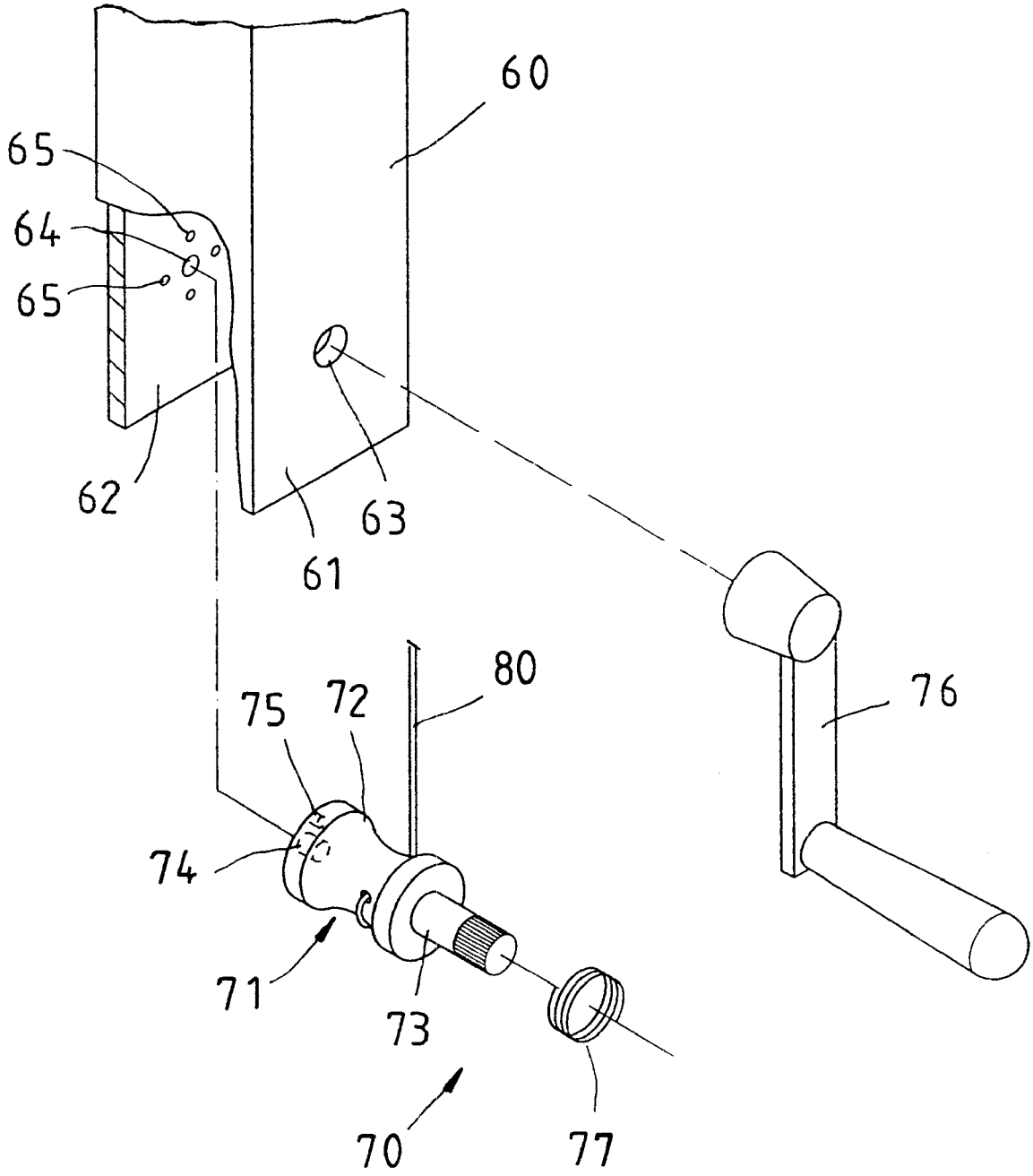
FIG. 9 is a perspective exploded view of a part of the second embodiment of the present invention, showing the structure of the winding mechanism.

The body 41 of the lift cord endpiece 40 is fastened to the second ends of the lift cords 30 inside the sleeve 20. As illustrated in FIG. 7, the second end of each lift cords 30 is inserted through the center through hole 43 into the inside of the body 41 and then tied up into a knot inside the bottom chamber 42 of the body 41.

The Venetian blind 10 further comprises a tilting control mechanism adapted for controlling the tilting angle of the slats. Because the tilting control mechanism is of the known art and not within the scope of the claims of the present invention, no further detailed description in this regard is necessary.

Figure 3:
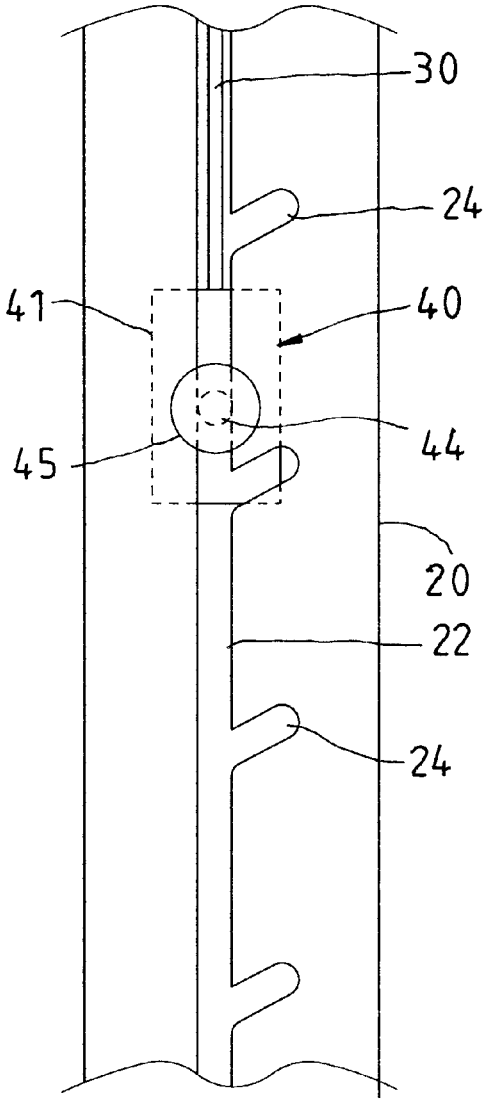
FIG. 3 is a schematic drawing showing the lift cord endpiece disengaged from the elongated retaining notches for free movement along the longitudinal slot according to the first embodiment of the present invention.
Figure 5:
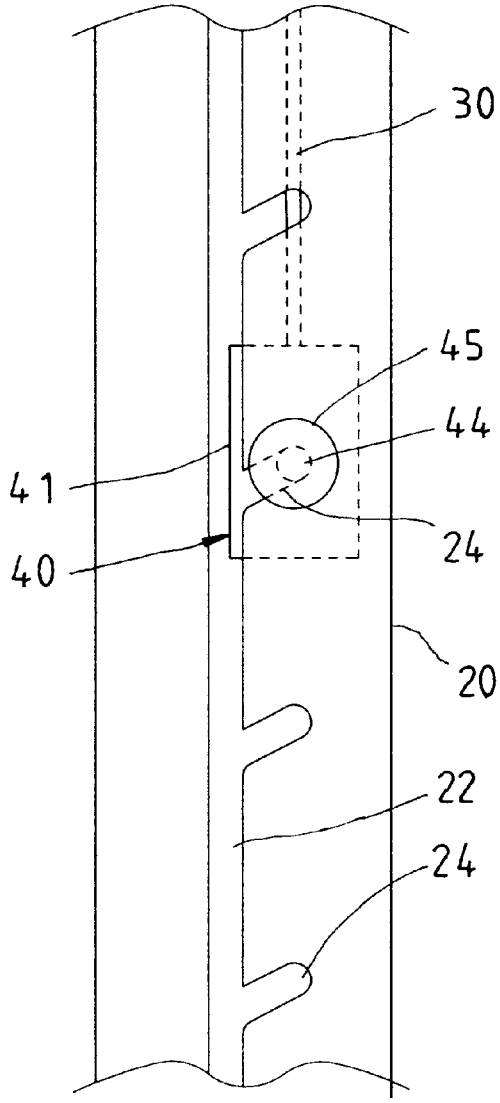
FIG. 5 is similar to FIG. 3 but showing the lift cord endpiece engaged in one elongated retaining notch of the sleeve.
Figure 4:
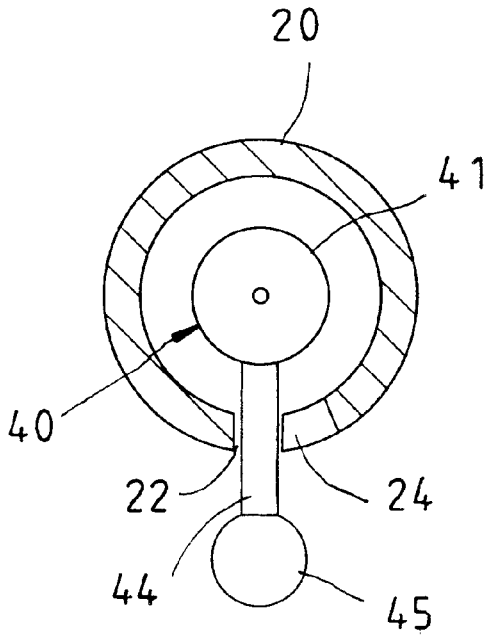
FIG. 4 is a top view of FIG. 3.
Figure 6:
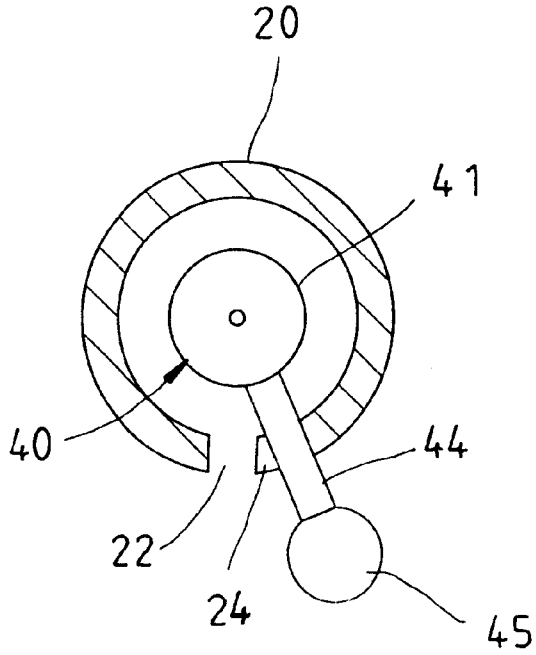
FIG. 6 is a top view of FIG. 5.

According to the aforesaid structure, the user can hold the spherical knob 45 of the lift cord endpiece 40 to move the lift cord endpiece 40 along the longitudinal slot 22 to the desired elevation (see FIGS. 3 and 4). When pulled the lift cord endpiece 40 downwards to lower the second ends of the lift cords 30, the bottom rail 14 is lifted with the first ends of the lift cords 30, thereby causing the slats 16 to be received to the headrail 12. On the contrary, when reducing the pull force from the lift cord endpiece 40, the bottom rail 14 will fall to the bottom side due to the effect of its gravity weight, thereby causing the slats 16 to be lowered and extended out and the lift cords to be pulled downwards with the bottom rail 14 to lift the lift cord endpiece 40. When the user moved the lift cord endpiece 40 sideways to force the rod 44 into one elongated retaining notch 24, as shown in FIGS. 5 and 6, the lift cord endpiece 40 is locked, and therefore the bottom rail 14 is stopped in position, keeping the blind in the corresponding extended status.

As indicated above, the user can easily control the lifting and positioning of the Venetian blind 10. Further, because the protruded sections of the lift cords 30 outside the headrail 12 are received in the sleeve 20, the lift cords 30 are kept out of reach of children and prohibited from hooking the arm or neck of the person touching or operating the Venetian blind 10 accidentally.

FIGS. from 8 through 11 show a Venetian blind according to a second embodiment of the present invention. According to this alternate form, the Venetian blind 50 comprises, a headrail 52, a bottom rail 54, a set of slats 56, a sleeve 60, a winding mechanism 70, and two lift cords 80. The structure and arrangement of the headrail 52, bottom rail 54 and slats 56 of this embodiment are same as the corresponding members of the aforesaid first embodiment of the present invention. According to this embodiment, the sleeve 60 is a straight tube of rectangular cross section suspended from the headrail 52. The top end of the sleeve 60 is fastened to the bottom side of the first end 53 of the headrail 52. The sleeve 60 has a proper length such that the user's hand is conveniently reachable to the bottom end of the sleeve 60 for operation. The sleeve 60 has two pivot holes 63;64 respectively disposed in front and rear sidewalls 61;62 thereof, and a plurality of, for example, four locating holes 65 disposed in the rear sidewall 62 around the corresponding pivot hole 64.

Figure 10:
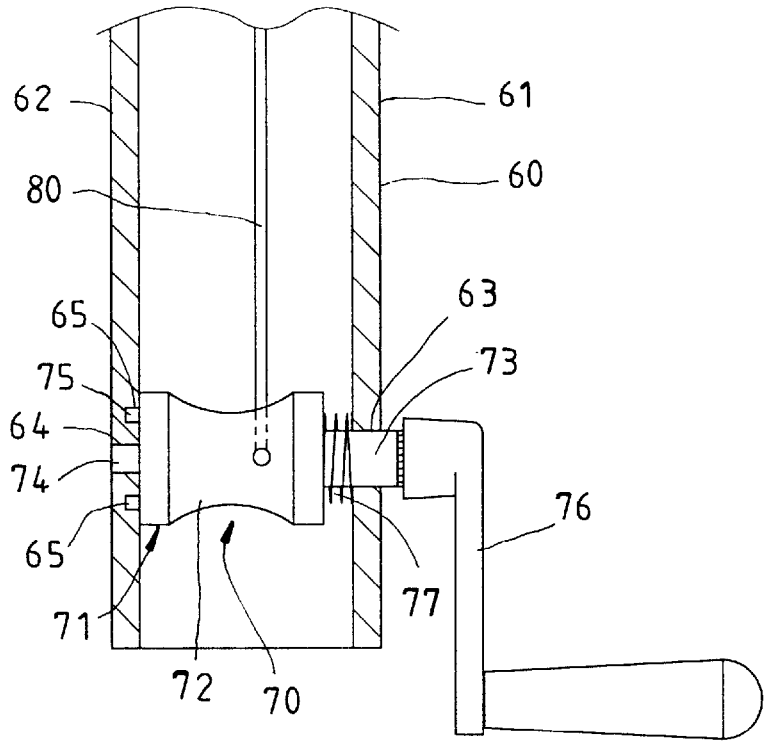
FIG. 10 is a schematic side view showing the bobbin of the winding mechanism locked according to the second embodiment of the present invention.
Figure 11:
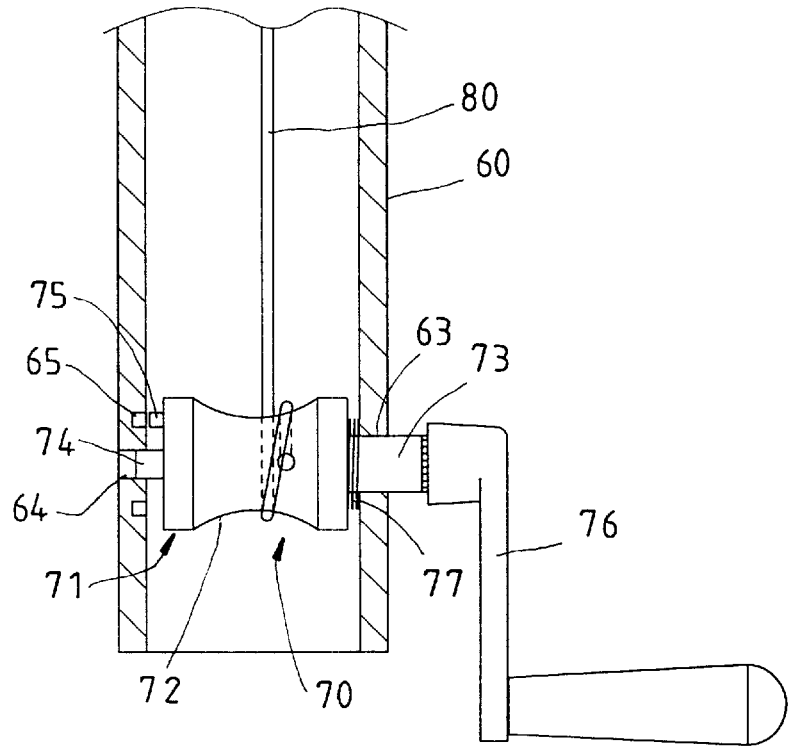
FIG. 11 is similar to FIG. 10 but showing the bobbin unlocked.

The winding mechanism 70 is mounted in the bottom end of the sleeve 60, comprised of a bobbin 71, a handle 76, and a spring 77. The bobbin 71 comprises a body 72, a front round rod 73 axially extended from the center of one end of the body 72, a rear round rod 74 axially extended from the center of the other end of the body 72, and a pin 75 protruded from one end of the body 72 adjacent to the rear round rod 74. The round rods 73;74 are respectively pivotally mounted in the pivot holes 63;64 of the sleeve 60. After installation of the bobbin 71 in the sleeve 60, the bobbin 71 can be rotated on its own axis, and moved axially between the sidewalls 61;62 of the sleeve 60 within a limited arrange (between the position shown in FIG. 10 and the position shown in FIG. 11). The handle 76 may be various shaped. According to this embodiment, the handle 76 is a crank handle fastened to the end of the front round rod 73 and disposed outside the sleeve 60 for operation by hand to rotate the bobbin 71 causing it to wind up the lift cords 80. The spring 77 is mounted on the front round rod 73 inside the sleeve 60, having one end stopped at the inner surface of the front sidewall 61 of the sleeve 60 and the other end stopped against one end of the body 72 of the bobbin 71. According to this embodiment, the spring 77 is a compression spring that forces the bobbin 71 backwardly away from the front sidewall 61 of the sleeve 60 toward the rear sidewall 62, keeping the bobbin 71 in the rear position shown in FIG. 10.

The lift cords 80 each have a first end fixedly fastened to the bottom rail 54, and a second end upwardly inserted through the slats 56 into the inside of the headrail 52 and then extended transversely to the first end 53 of the headrail 52 and then turned vertically downwards into the inside of the sleeve 60 and fixedly fastened to the periphery of the body 72 of the bobbin 71 (in the drawings, the second ends of the lift cords 80 are joined into one single rope in the sleeve 60 and then fixedly fastened to the periphery of the body 72 of the bobbin 71).

Normally, the spring 77 holds the bobbin 71 in the rear position where the pin 75 is engaged into one locating hole 65 of the sleeve 60 to stop the bobbin 71 from rotation, keeping the second ends of the lift cords 80 fixed to the bottom end of the sleeve 60, and therefore the bottom rail 54 is held in position. When adjusting the extending area of the blind, the user can pull the handle 76 outwards to disengage the pin 75 from the locating holes 65 of the sleeve 60 (see FIG. 11), and then rotate the handle 71 clockwise or counter-clockwise, causing the bobbin 72 to wind up or let off the lift cords 80. When the bobbin 72 rotated clockwise to wind up the lift cords 80, the bottom rail 54 is lifted. On the contrary, when the bobbin 72 rotated counter-clockwise to let off the lift cords 80, the bottom rail 54 is lowered. When the bottom rail 54 adjusted to the desired elevation, release the hand from the handle 76, enabling the pin 75 of the bobbin 71 to be forced into one locating hole 65 of the sleeve 60 by the spring power of the spring 77 to lock the bobbin 71 again (see FIG. 10).

The aforesaid winding mechanism may be variously embodied. Further, a spiral or torsional spring may be used to impart a winding force to the bobbin.

What the invention claimed is:

1. A Venetian blind comprising:

a headrail extended in transverse direction, said headrail having a first end;

a bottom rail extended in transverse direction and spaced below said headrail;

a plurality of slats arranged in parallel between said headrail and said bottom rail;

at least one lift cord, said at least one lift cord each having a first end fixedly fastened to said bottom rail and a second end upwardly inserted through said slats into the inside of said headrail and then transversely extended to the first end of said headrail and then extended vertically downwardly out of the first end of said headrail;

a sleeve vertically downwardly suspended from the first end of said headrail and adapted for receiving the second end of each of said at least one lift cord, wherein the second end of each of said at least one lift cord is extended out of the first end of said headrail and received inside said sleeve for positioning in said sleeve, wherein said sleeve comprises a longitudinal slot and a plurality of elongated retaining notches respectively extended sideways from said longitudinal slot at different elevations;

the Venetian blind further comprises a lift cord endpiece which is fixedly fastened to the second end of each of said at least one lift cord and adapted for securing the second end of each of said at least one lift cord to one of said elongated retaining notches of said sleeve, said lift cord end piece having a body received inside said sleeve and fastened to the second end of each of said at least one lift cord; and a rod perpendicularly extended from the periphery of said body to the outside of said sleeve through one of said elongated retaining notches of said slot, and a spherical knob fixedly fastened to said rod and disposed outside said sleeve for the holding said endpiece in position.

2. The Venetian blind as claimed in claim 1, wherein the length of said sleeve is approximately equal to the vertical length of a window that the Venetian blind is applied to, and the longitudinal slot of said sleeve extends between two distal ends of said sleeve.

3. The Venetian blind as claimed in claim 1, wherein said elongated retaining notches of said sleeve extend obliquely upwardly from said longitudinal slot at different elevations.

4. A Venetian blind comprising:

a headrail extended in transverse direction, said headrail having a first end;

a bottom rail extended in transverse direction and spaced below said headrail;

a plurality of slats arranged in parallel between said headrail and said bottom rail;

at least one lift cord, said at least one lift cord each having a first end fixedly fastened to said bottom rail and a second end upwardly inserted through said slats into the inside of said headrail and then transversely extended to the first end of said headrail and then extended vertically downwardly out of the first end of said headrail;

a sleeve vertically downwardly suspended from the first end of said headrail and adapted for receiving the second end of each of said at least one lift cord, wherein the second end of each of said at least one lift cord is extended out of the first end of said headrail and received inside said sleeve for positioning in said sleeve;

a winding mechanism installed in a bottom end of said sleeve remote from said headrail and connected with the second end of said at least one lift cord for winding up said at least one lift cord;

said sleeve comprises a front pivot hole and a rear pivot hole aligned at two sides near a bottom end thereof and at least one locating hole disposed adjacent to said rear pivot hole;

said winding mechanism comprises a bobbin pivoted to said sleeve and adapted for winding up said at least one lift cord, said bobbin including a body peripherally fastened to the second end of each of said lift cord, a front round rod axially extended from one end of said body and inserted through said front pivot hole to the outside of said sleeve, a rear round rod axially extended from an opposite end of said body and inserted into said rear pivot hole, and a pin protruded from one end of said body adjacent to said rear round rod and adapted for engaging into one of said at least one locating hole to stop said bobbin from rotation;

a spring member mounted on said front round rod inside said sleeve and stopped between an inside wall of said sleeve and one end of said body of said bobbin to force said pin of said bobbin into engagement with said at least one locating hole; and a handle fastened to said front round rod and disposed outside said sleeve for operation by hand to pull said bobbin forwards against said spring member and to disengage said pin of said bobbin from said at least one locating hole and then to rotate said bobbin to wind up said at least one lift cord.

* * * * *